US005175590A

United States Patent [19]

Frankel et al.

[11] Patent Number: 5,175,590

[45] Date of Patent: Dec. 29, 1992

[54] APPARATUS AND METHOD FOR REMOVING DEVELOPER MATERIAL

[75] Inventors: Neil A. Frankel, Rochester; Edward J. Gutman, Webster; Larry G. Hogestyn, Ontario, all of N.Y.

[73] Assignee: Xerox Corporation, Stamford, Conn.

[21] Appl. No.: 886,222

[22] Filed: May 21, 1992

[51] Int. Cl.[5] ..... G03G 21/00

[52] U.S. Cl. ..... 355/296; 355/271; 355/274

[58] Field of Search ..... 355/296, 301, 302, 303, 355/304, 204, 207, 208, 271, 274; 15/256.51, 256.52, 1.5; 118/652

[56] References Cited

U.S. PATENT DOCUMENTS

| | | | |
|---|---|---|---|
| 4,076,407 | 2/1978 | Place, Jr. . | |
| 4,078,929 | 3/1978 | Gundlach | 96/1.2 |
| 4,190,348 | 2/1980 | Friday . | |
| 4,533,236 | 8/1985 | Garsin . | |
| 4,615,613 | 10/1986 | Garsin . | |
| 4,999,673 | 3/1991 | Bares | 355/208 |
| 5,006,892 | 4/1991 | Roehrs et al. | 355/208 |
| 5,016,050 | 5/1991 | Roehrs et al. | 355/208 |
| 5,019,859 | 5/1991 | Nash | 355/77 |
| 5,045,882 | 9/1991 | Roehrs et al. | 355/208 |

OTHER PUBLICATIONS

Lindblad, Nero R. and Pozzanghera, Darryl L., "Dual Electrostatic Brush Cleaner for Cleaning Multiple Toner Types", *Xerox Disclosure Journal*, vol. 15, No. 6, Nov./Dec. 1990, pp. 463-466.

Jackson, Mark S., "Variable Detach Level Strategy to Facilitate Lead-Edge Stripping", *Xerox Disclosure Journal*, vol. 8, No. 2, Mar./Apr. 1983, pp. 143-144.

*Primary Examiner*—Richard L. Moses

*Attorney, Agent, or Firm*—Gary B. Cohen

[57] ABSTRACT

A printing machine of the type including an image receiving member having a charge retentive surface with a first developed image being disposed in a first zone and a second developed image being disposed in a second zone is provided. The printing machine preferably including a corona generator positioned adjacent the charge retentive surface and characterized by an electrical parameter; a first control device for setting the electrical parameter to a first level for disposing the first developed image at a first charge level as the first developed image is passed by the corona generator; a second control device for changing the electrical parameter to a second level for disposing the second developed image at a second charge level as the second developed image is passed by the corona generator; and a cleaning member, contacting the charge retentive surface, for substantially removing both the first developed image and a portion of the second developed image from the the charge retentive surface, wherein the capacity of the cleaning member to remove the first developed image and the portion of the second developed image from the charge retentive surface depends on the magnitudes of the first and second levels.

14 Claims, 7 Drawing Sheets

FIG. 5A
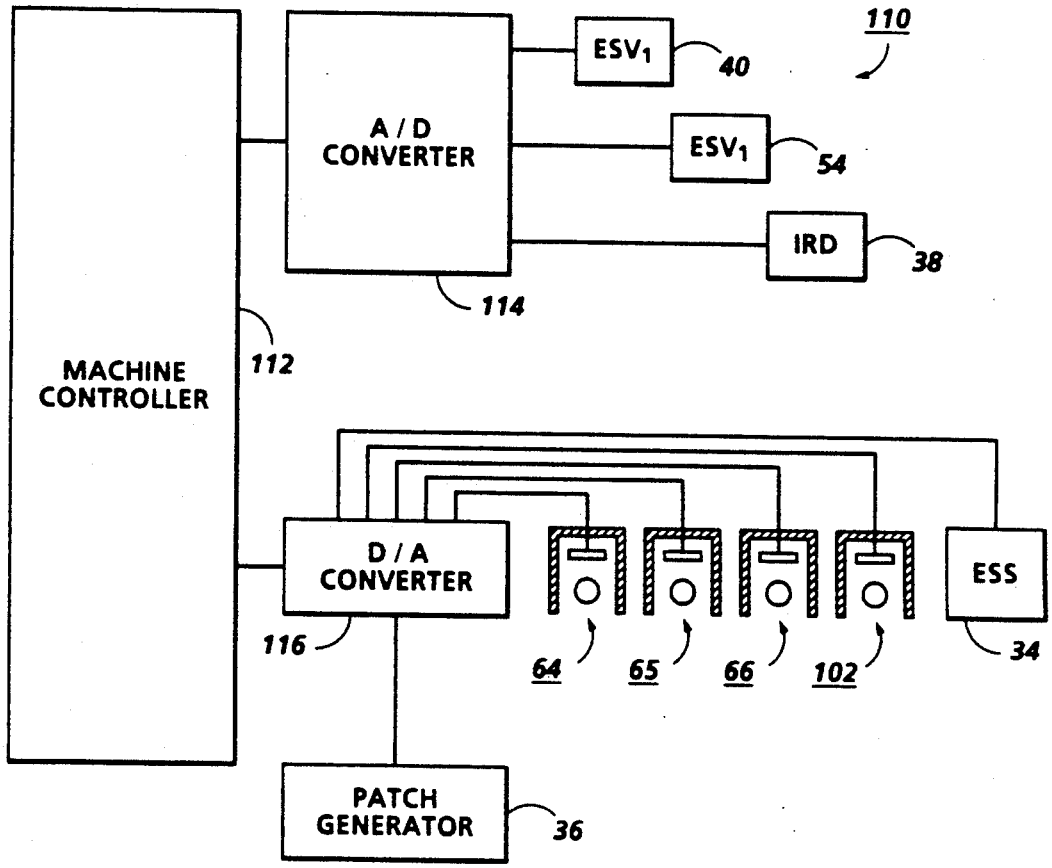
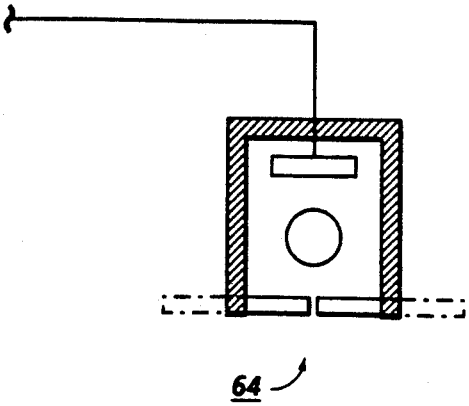
FIG. 5B

APPARATUS AND METHOD FOR REMOVING DEVELOPER MATERIAL

The present invention relates generally a technique for cleaning developer material from a photoreceptive member and more particularly to an apparatus and method adapted to remove the developer material from document and interdocument zones of the photoreceptive member by changing an applied current level of a corona generating device as the zones are passed thereby.

In electrophotographic applications such as xerography, a charge retentive surface is electrostatically charged and exposed to a light pattern of an original image to be reproduced for selectively discharging the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development and transfer, excess toner left on the charge retentive surface is cleaned from the surface. The process is well known, and useful for light lens copying from an original, and printing applications from electronically generated or stored originals, where a charged surface may be imagewise discharged in a variety of ways.

Although a preponderance of the toner forming the image is transferred to the paper during transfer, some toner invariably remains on the charge retentive surface, it being held thereto by relatively high electrostatic and/or mechanical forces. A commercially successful mode of cleaning employed in automatic xerography utilizes a brush with soft fiber bristles which have suitable triboelectric characteristics. While the bristles are soft they are sufficiently firm to remove residual toner particles from the charge retentive surface. In addition, webs or belts of soft fibrous or tacky materials and other cleaning systems are known.

A process referred to as "highlight color imaging" has been accomplished by employing basic xerographic techniques. The concept of tri-level, highlight color xerography is described in the following patent:

U.S. Pat. No. 4,078,929, Patentee: Gundlach, Issued: Mar. 14, 1978.

U.S. Pat. No. 4,078,929 discloses the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to −900 volts, and exposed imagewise, such that one image corresponding to charged image areas (which are subsequently developed by charged-area development, i.e. CAD) stays at the full photoreceptor potential ($V_{cad}$ or $V_{ddp}$). $V_{ddp}$ is the voltage on the photoreceptor due to the loss of voltage while the photoreceptor remains charged in the absence of light, otherwise known as dark decay. Another image is exposed to discharge the photoreceptor to its residual potential, i.e. $V_{dad}$ or $V_c$ (typically −100 volts), which $V_c$ corresponds to discharged area images that are subsequently developed by discharged-area development (DAD). The background area is exposed so as to reduce the photoreceptor potential to halfway between the $V_{cad}$ and $V_{dad}$ potentials, (typically −500 volts) and is referred to as $V_{white}$. The CAD developer is typically biased about 100 volts closer to $V_{cad}$ than $V_{white}$ (about −600 volts), and the DAD developer system is biased about 100 volts closer to $V_{dad}$ than $V_{white}$ (about −400 volts). As will be appreciated, the highlight color need not be a different color but may have other distinguishing characteristics. For example, one toner may be magnetic and the other non-magnetic.

It is generally well known to control and adjust particular parameters of an electrophotographic printing machine. For example, individual control signals can be used to adjust operating elements of a printing machine, such as controlling development by control of the ratio of toner particles to carrier granules in the developer material and the electrical bias applied to the developer roller. Other control techniques compare a signal measuring the reflected light from a clean photoconductive member to a signal reflected from a developed test patch formed thereon. The resultant error signal regulates toner dispensing to control the concentration of toner particles in the developer material on the photoconductive surface. Generally, the density of the developer material developed on the test patch is monitored by an infrared densitometer. In various applications, the photoreceptive member includes at least two document zones and an interdocument zone disposed therebetween. Preferably, an image from a document is developed in the document zone while the test patch is developed in the interdocument zone. Typically, the test patch is formed in the interdocument zone so as not to interfere with imaging in the document zone. The following patents and applications pertain to arrangements for generating and monitoring toner density of developed test patches disposed in interdocument zones:

U.S. patent application Ser. No. 07/755,193, Applicants: Scheuer et al., Filed: Sep. 5, 1991.

U.S. patent application Ser. No. 07/755,197, Applicants: Berman et al., Filed: Sep. 5, 1991.

U.S. Pat. No. 4,999,673, Patentee: Bares, Issued: Mar. 12, 1991.

U.S. Pat. No. 5,019,859, Patentee: Nash, Issued: May 28, 1991.

Ineffective cleaning can be encountered when a test patch is formed in the interdocument zone. That is, while much of toner is removed from the document zone during the transfer stage, all of the toner comprising the test patch remains in the interdocument zone right up until the cleaning stage. Moreover, commonly during transfer and detack, the document and interdocument zones are not charged to the same polarity levels. Indeed, these zones can even possess opposing polarities. The following references disclose systems adapted to clean a belt with zones of varying toner density:

U.S. Pat. No. 4,533,236, Patentee: Garsin, Issued: Aug. 6, 1985.

U.S. Pat. No. 4,615,613, Patentee: Garsin, Issued: Oct. 7, 1986.

U.S. Pat. No. 4,615,613 discloses a cleaning brush having different biases applied thereto in accordance the area of the charge retentive surface being cleaned. Preferably, when toner is being removed from the document area of the charge retentive surface, one bias level is applied and when the interdocument area is being cleaned a different bias is applied.

Ineffective cleaning can also be encountered when using a typical highlight color apparatus in which toners of varying triboelectric characteristics are employed. For example, as explained in the following disclosure, it may be desirable to employ two electrostatic brushes with differing polarities to remove toners of differing preferences:

Lindblad, L. R. and Pozzanghera, D. L., *Dual Electrostatic Brush Cleaner for Cleaning Multiple Toner Types*, Xerox Disclosure Journal, Vol. 15, No. 6 at pp. 463–466, Published: November/December 1990.

It is well known in the art to adjust a transfer voltage level in order to maximize transfer efficiency under changed transfer conditions, such as humidity changes. A general discussion of references in which transfer voltage level has been adjusted to maximize transfer efficiency can be found in the following patent:

U.S. Pat. No. 4,076,407, Patentee: Place, Jr., Issued: Feb. 28, 1978.

The following references particularly relate to the adjustment of transfer voltage levels to facilitate image transfer and/or stripping:

U.S. Pat. No. 4,190,348, Patentee: Friday, Issued: Feb. 26, 1980.

Jackson, M. S., *Variable Detack Level Strategy to Facilitate Lead-Edge Stripping*, Xerox Disclosure Journal, Vol. 8, No. 2 at p. 143, Published: March/April 1983.

The following patent application relates to adjusting respective operating parameters of corona generating devices for removing a test patch during cycle up and runtime of a highlight color imaging device:

U.S. patent application Ser. No. 07/755,467, Applicants: Macdonald et al., Filed: Sep. 5, 1991.

U.S. patent application Ser. No. 07/755,467 discloses a technique in which single pass cleaning of developed patches during cycle up convergence ("cycle up") is enabled by setting a plurality of corona generating devices to a first set of preselected values, and storing the values into a memory. A second set of values for setting the devices can be stored in the memory for cleaning during runtime ("runtime"). Preferably, the corona generating devices are operated with the first set of preselected values during cycle up, and with the second set of preselected values during runtime.

While U.S. patent application Ser. No. 07/755,467 discloses an arrangement in which the electrical parameters of a set of corona generating devices can be adjusted prior to either cycle up or runtime for facilitating cleaning of developed test patches, it does not contemplate a technique in which the corona generating devices can be switched during cycle up or runtime to compensate for density and charge level differences between the document and interdocument zones of the photoreceptor. Indeed, it would be desirable to provide an apparatus and method in which one or more of the corona generating devices could be switched between voltage levels to facilitate optimal cleaning of the developer material residuals from the document and interdocument zones.

In accordance with a disclosed embodiment of the present invention there is provided a printing machine of the type including an image receiving member having a charge retentive surface with a first developed image being disposed in a first zone and a second developed image being disposed in a second zone. The printing machine preferably comprises a corona generator positioned adjacent the charge retentive surface and characterized by an electrical parameter; means for setting the electrical parameter to a first level for disposing the first developed image at a first charge level as the first developed image is passed by the corona generator; means for changing the electrical parameter to a second level for disposing the second developed image at a second charge level as the second developed image is passed by the corona generator; and a cleaning member, contacting the charge retentive surface, for substantially removing both the first developed image and a portion of the second developed image from the charge retentive surface, wherein the capacity of the cleaning member to remove the first developed image and the portion of the second developed image from the charge retentive surface depends on the magnitudes of the first and second levels.

These and other aspects of the invention will become apparent from the following description, the description being used to illustrate a preferred embodiment of the invention when read in conjunction with the accompanying drawings.

FIG. 5A is a schematic view of a control circuit used to control various components of the printing machine of FIG. 2;

FIG. 5B is a schematic view of a corona generator with a shutter for selectively changing the emission therefrom;

Figure 2:
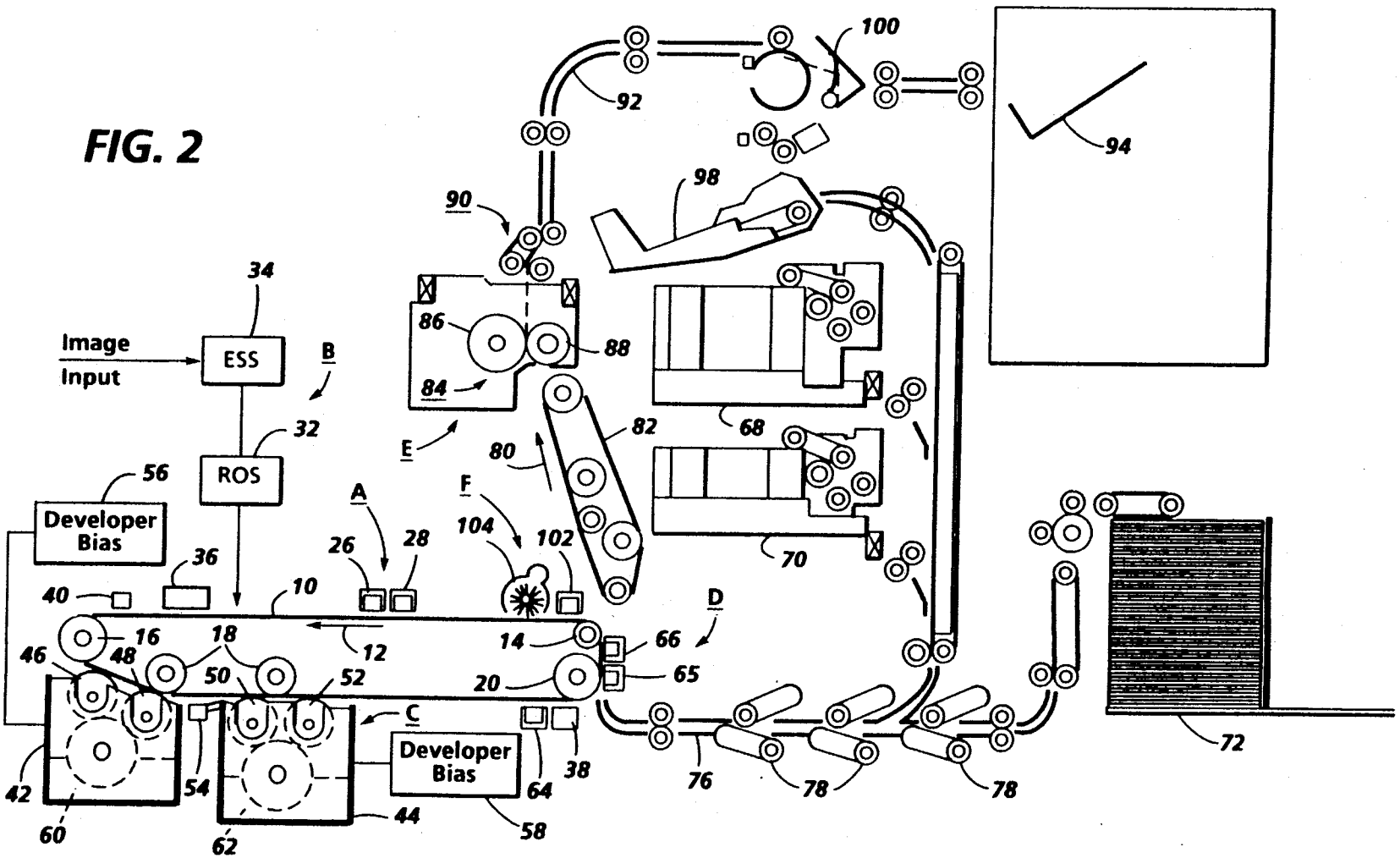
FIG. 2 is a schematic, view of a printing machine incorporating various features the present invention.
Figure 7:
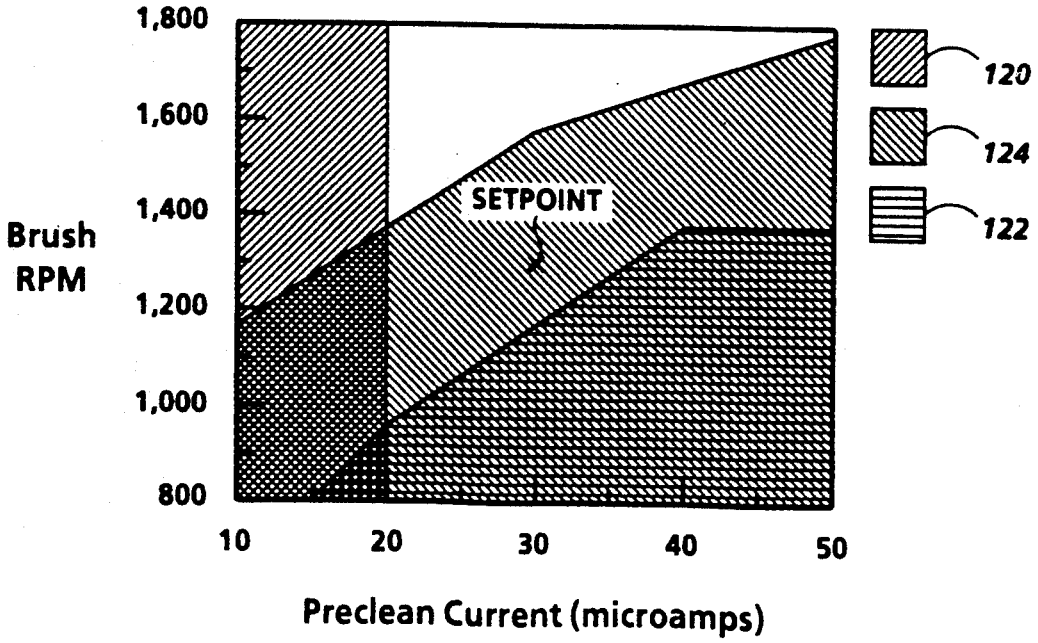
Figure 8:
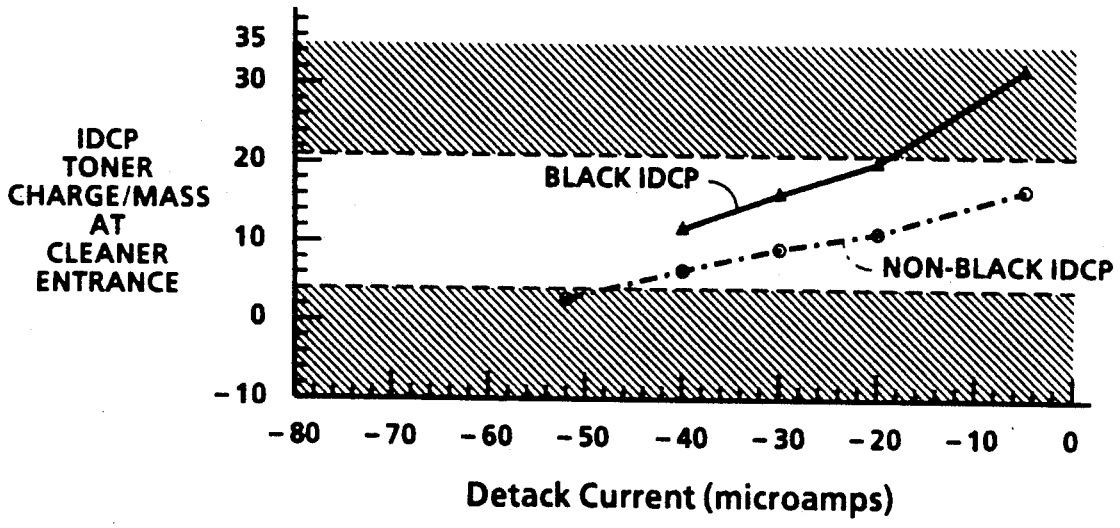

FIG. 7 is a cleaning latitude window showing acceptable set points for the printing machine of FIG. 2 in which the applied current level for the transfer corona generator has been optimized to improve transfer efficiency; and FIG. 8 is a cleaning latitude window showing acceptable detack current settings for the printing machine of FIG. 2, the latitude window specifically illustrating the effect of changing detack current on cleaning while maintaining other settings at constant levels.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1A:
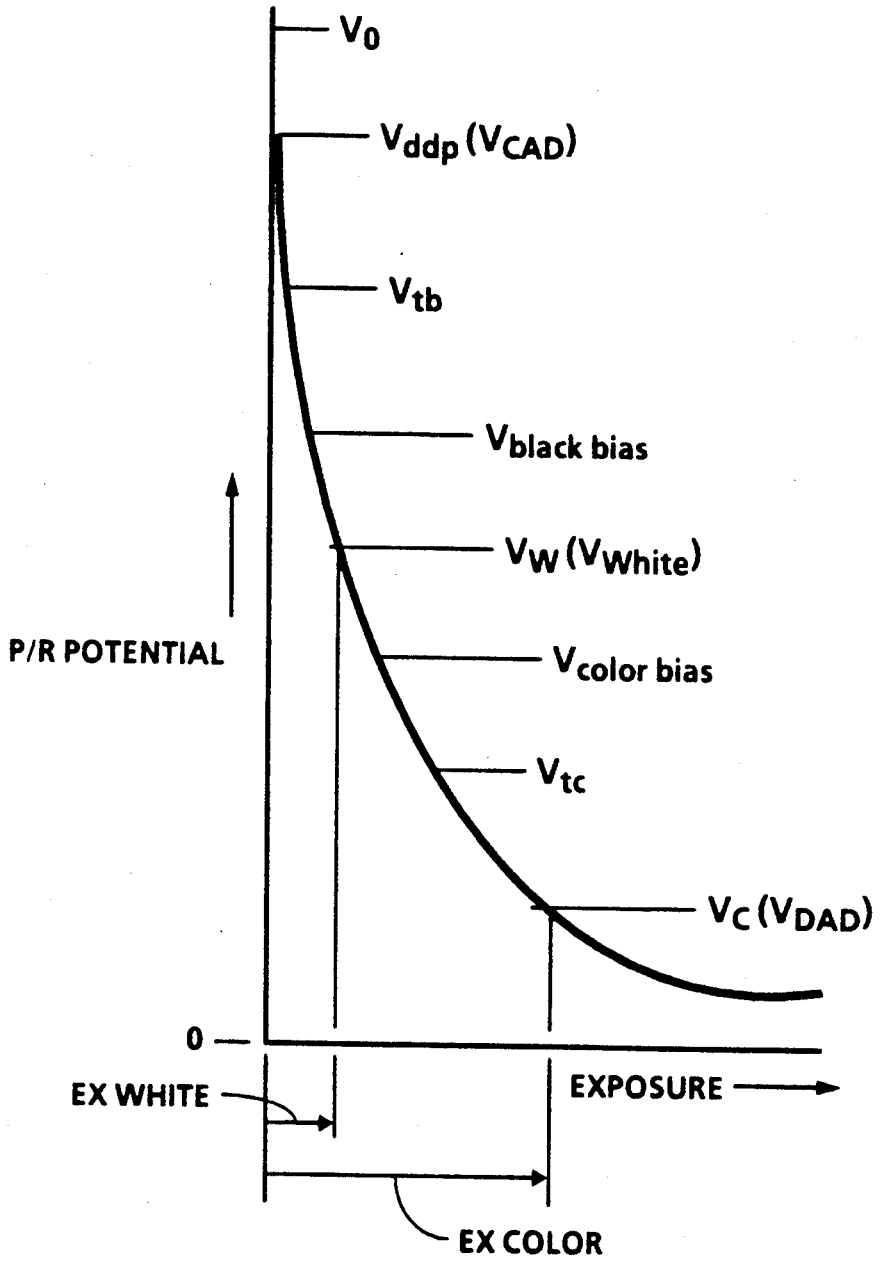
FIG. 1A PRIOR ART
FIG. 1A is a plot of photoreceptor potential versus exposure, for a tri-level electrostatic latent image.
Figure 1B:
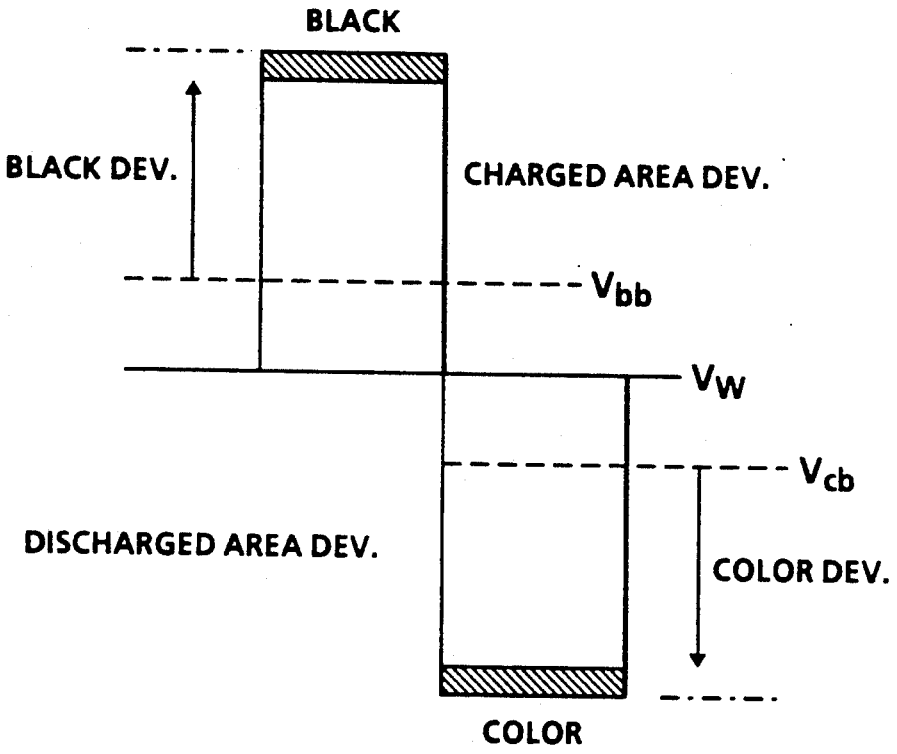
FIG. 1B PRIOR ART
FIG. 1B is a plot of photoreceptor potential representing particular single-pass, highlight color latent image characteristics.

Referring to FIGS. 1A and 1B, the concept of tri-level highlight color imaging is described generally. For a photo-induced discharge curve ("PIDC") of FIG. 1A, $V_0$ represents the initial charge level, $V_{ddp}$ ($V_{CAD}$) the dark discharge potential (unexposed), $V_{White}$, the white or background discharge level, and $V_c$ ($V_{DAD}$) the photoreceptor residual potential. In one example, nominal voltage magnitudes for $V_{CAD}$, $V_{White}$ and $V_{DAD}$ are 788 v, 423 v and 123 v, respectively.

In highlight color applications, color discrimination in the development of the electrostatic latent image is achieved by passing the photoreceptor, with a latent image disposed thereon, through first and second developer housings and biasing the housings to voltages which are offset from the background voltage $V_{White}$. In one illustrated embodiment, the second housing contains developer with positively charged black toner. Accordingly, the toner from the second housing is driven to the most highly charged ($V_{ddp}$) areas of the latent image by the electrostatic field between the photoreceptor and the development rolls in the second housing. the second housing development rolls being biased at $V_{black\ bias}$ ($V_{bb}$). The first housing contains negatively charged colored toner. Accordingly, the toner from the first housing is urged towards parts of the latent image at the residual potential, namely $V_{DAD}$, by the electrostatic field existing between the photoreceptor and the development rolls of the first housing, the first housing rolls being biased to $V_{color\ bias}$, ($V_{cb}$). In one example, nominal voltage magnitudes for $V_{bb}$ and $V_{cb}$ are 641 v and 294 v, respectively.

Referring to FIG. 2, a reproduction machine in which the present invention finds advantageous use employs a photoreceptor belt 10 having a charge retentive surface. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

Figure 3:
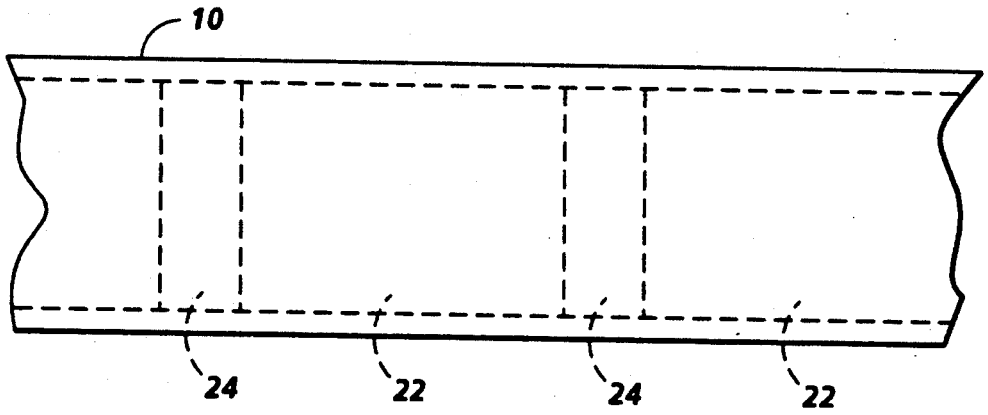
FIG. 3 is a partial, plan view of a photoreceptive belt used in the printing machine of FIG. 2.

Referring to FIG. 3, in the preferred embodiment of the present invention, latent images from documents are formed respectively in document portions or zones of the charge retentive surface of the photoreceptor, each of which document zones is designated by the numeral 22. Areas interposed between the document zones 22, are referred to as interdocument zones, and are designated by the numeral 24.

Referring again to FIG. 2, portions of the belt 10 pass through charging station A. At charging station A, a pair of corona devices 26 and 28 charge successive portions 22, 24 of the photoreceptor belt 10 to a relatively high, substantially uniform negative potential.

At exposure station B, the uniformly charged photoreceptor is exposed to a laser based scanning device 32 or ROS, which, in accordance with a driving ESS 34, discharges the photoreceptor to one of three charge levels in accordance with a stored image. This records an electrostatic latent image on the belt which corresponds to the informational area contained within electronically stored original information. The ROS could be replaced with a conventional electrophotographic exposure arrangement.

In the preferred modé of operation, the charge retentive surface of the belt 10, which is initially charged to a voltage $V_0$, undergoes dark decay to a level $V_{ddp}$ or $V_{CAD}$ equal to about −900 volts to form CAD images. Upon being exposed at the exposure station B, the photoreceptor is discharged to $V_c$ or $V_{DAD}$ equal to about −100 v to form a DAD image which is about zero or ground potential in the highlight color parts of the image. During exposure, the charge retentive surface of the belt 10 is also discharged to $V_{White}$, the magnitude of $V_{White}$ equaling approximately −500 v in the background (white) areas.

Referring still to FIG. 2, a patch generator is designated by the numeral 36. In one example, the generator 36 comprises a conventional exposure device, and serves to record test or control patches in the interdocument zones 24, the test patches being used both in a developed and undeveloped condition for controlling various process functions. An Infra-Red densitometer (IRD) 38 is utilized to sense or measure the reflectance of test patches after they have been developed. It should be recognized that each test patch can be recorded and developed with multiple toners having differing polarities. Thus, the patch generator 36 is preferably adapted to provide different levels of exposure for any one given interdocument zone 24. A first electrostatic voltmeter ($ESV_1$) 40 is positioned downstream of the patch generator 36 for monitoring certain electrostatic charge levels (i.e. $V_{DAD}$, $V_{CAD}$, $V_{White}$, and $V_{tc}$) on various portions of the photoreceptive belt 10.

At development station C, a magnetic brush development system advances developer materials into contact with an electrostatic latent images on the photoreceptor. The development station C comprises a first developer housing 42 and second developer housing 44. Preferably, the housing 42 contains a pair of magnetic brush developer rollers 46, 48 while the housing 44 contains a pair of magnetic brush developer rollers 50, 52. Each pair of rollers advances its respective developer material into contact with the latent image. Appropriate developer biasing is accomplished via power supplies 56 and 58, the power supplies 56, 58 being electrically coupled with respective developer housings 42, 44. A pair of toner replenishment devices (not shown) are provided for replacing the toner as it is depleted from the developer housing structures 42, 44.

Color discrimination in the development of the electrostatic latent image is achieved by passing the photoreceptor past the two developer housings 42 and 44 in a single pass with the magnetic brush rolls 46, 48, 50 and 52 electrically biased to voltages which are offset from the background voltage $V_{White}$ in a direction depending on the polarity of toner in the housing. In the illustrated embodiment of FIG. 2, the housing 42 contains negatively charged blue conductive magnetic brush (CMB) developer 60. Accordingly, the blue toner is driven to the least highly charged areas at the potential $V_{DAD}$ of the latent images by the electrostatic development field ($V_{DAD}-V_{color\ bias}$) between the photoreceptor and the development rolls 46, 48. On the other hand, the housing 44 contains positively charged black toner 62. Accordingly, the black toner is urged towards the parts of the latent images at the most highly charged potential $V_{CAD}$ by the electrostatic development field ($V_{CAD}-V_{black\ bias}$) existing between the photoreceptor and the development rolls 50, 52. A second electrostatic voltmeter ($ESV_2$) 54 is positioned downstream of the first developer housing 42 for monitoring certain electrostatic charge levels (i.e. $V_{DAD}$, $V_{CAD}$, $V_{White}$, $V_{tb}$ and $V_{tc}$) on various portions of the photoreceptive belt 10.

Preferably, the rollers 46 and 48 are biased using a chopped DC bias via power supply 56, while the rollers 50 and 52 are biased using a chopped DC bias via power supply 58. The expression chopped DC ("CDC") bias refers to the process of alternating a developer housing between two potentials, namely a first potential roughly representing the normal bias for the DAD developer, and a second potential roughly representing a bias that is considerably more negative than the normal bias. The first potential is identified as $V_{Bias\ Low}$ while the second potential as $V_{Bias\ High}$. Further details regarding CDC biasing are provided in U.S. Pat. application Ser. No. 440,913, the pertinent portions of which are incorporated herein by reference.

Because the composite image developed on the photoreceptor consists of both positive and negative toner, a negative pretransfer dicorotron 64 is employed to condition the toner for effective transfer to a substrate using positive corona discharge. As will be appreciated from the discussion below, the concept of the invention would not be altered by conditioning the toner for transfer with negative corona discharge. Subsequent to providing pretransfer, belt 10 advances the developed latent image to transfer station D. At transfer station D, a sheet of support material such as a paper copy sheet is moved into contact with the developed latent images on belt 10 and a corona generating device 65 charges the copy sheet to the proper potential so that it is tacked to photoreceptor belt 10 and the toner powder image is attracted from photoreceptor belt 10 to the sheet. As will be appreciated by those skilled in the art, the generating device 65 could be replaced by, or used in conjunction with, one of many known transfer devices, such a bias transfer roll of the type used in a Xerox 9700 printer (the term "Xerox" is a registered trademark of the Xerox Corporation), an acoustical transfer assist device of the type disclosed in U.S. Pat. No. 5,081,500 to Snelling and an electrostatic transport device of the type used in a Konica 9028 printing apparatus, without altering the concept of the present invention. After transfer, a corona generator 66 charges the copy sheet with an opposite polarity to detack the copy sheet for belt 10, whereupon the sheet is stripped from belt 10 at stripping roller 14. For each interdocument zone 24 (FIG. 3), charge from the corona generators 65–66 is applied to each zone 24 as it is passed by the generators 65–66.

Sheets of support material are advanced to transfer station D from supply trays 68, 70 and 72, which supply trays may hold different quantities, sizes and types of support materials. Sheets are advanced to transfer station D along conveyor 76 and rollers 78. After transfer, the sheet continues to move in the direction of arrow 80 onto a conveyor 82 which advances the sheet to fusing station E.

Fusing station E, which includes a fuser assembly, indicated generally by the reference numeral 84, serves to permanently affix the transferred toner powder images to the sheets. Preferably, fuser assembly 84 includes a heated fuser roller 86 adapted to be pressure engaged with a back-up roller 88 with the toner powder images contacting fuser roller 86. In this manner, the toner powder image is permanently affixed to the sheet.

After fusing, copy sheets bearing fused images are directed through decurler 90. Chute 92 guides the advancing sheet from decurler 90 to catch tray 94 or a finishing station for binding, stapling, collating etc. and, removal from the machine by the operator. Alternatively, the sheet may be advanced to a duplex tray 98 from duplex gate 100 from which it will be returned to the processor and conveyor 76 for receiving second side copy.

A pre-clean corona generating device 102 is provided for exposing the residual toner and contaminants (hereinafter, collectively referred to as toner) to positive charges to thereby shift the charge distribution thereon in a positive direction for more effective removal at cleaning station F. The cleaning station F further includes an electrically insulative, rotatably mounted cleaning member designated by the numeral 104. In the preferred embodiment, the member 104 is a fibrous brush in contact with the surface of the belt 10. The insulative brush is capable of being charged up during rotation, via triboelectric interaction with other cleaning members, for attracting toner(s) of the opposite polarity. Alternatively, the brush could be a conductive brush adapted to be biased for attracting toner(s) of the opposite polarity. A conductive brush suited for such cleaning is disclosed in U.S. Pat. No. 4,819,026 to Lange et al., the pertinent portions of which are incorporated by reference. In another example, two brushes could be mounted in cleaning relationship relative to the surface of the belt 10 to achieve redundancy in cleaning. It is contemplated that residual toner remaining on charge retentive surface of belt 10 after transfer will be reclaimed and returned to the developer station C by any one of several well known reclaim arrangements.

Figure 4:
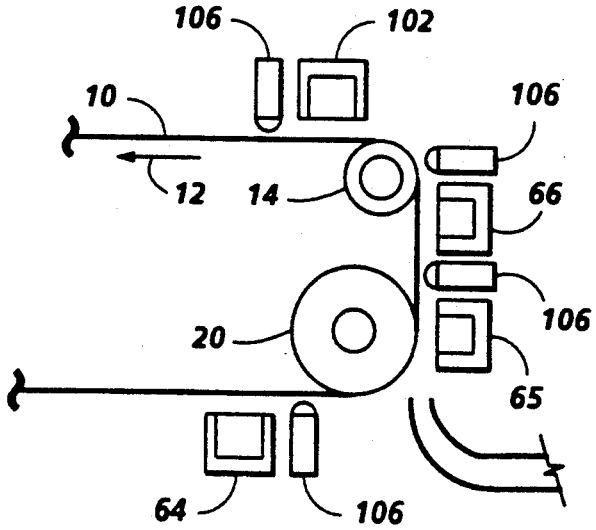
FIG. 4 is a blown-up, partial view of the printing machine of FIG. 2 with sensing devices positioned about the photoreceptive belt.

As will be understood from the discussion below, achievement of the present invention is facilitated by monitoring the position of belt 10 relative to the corona devices 64–66 and 102. Referring to FIG. 4, devices for sensing the position of belt 10 relative to such corona devices are each designated by the numeral 106. In one example, each of the sensors 106 is a reflective type sensor or a switch adapted to sense the front edge and rear edge of a sheet as it is passed thereby. It is contemplated that any arrangement for monitoring the position of belt 10 relative to the corona devices 64–66 and 102 would be suitable for use with the present invention. Examples of other such arrangements include U.S. Pat. No. Re. 32,967 to St John et al., and U.S. Pat. No.

4,963,899 to Resch, III, the pertinent portions of which are incorporated by reference.

Referring to FIG. 5A, a control circuit for use with the above-described xerographic engine is designated with the numeral 110. In the illustrated embodiment of FIG. 5A, the IRD 38, ESV1 40 and ESV2 54 are coupled with a machine controller 112 by way of an A/D converter 114, while the ESS 34, the patch generator 36 and the corona devices 64–66 and 102 are coupled with the controller 112 by way of a D/A converter 116. As will be appreciated by those skilled in the art, the machine controller 112 includes all of the appropriate circuitry for controlling the various devices coupled therewith and suitable memory for storing reference values corresponding to any measurements received from the ESV1, ESV2 or the IRD. In one embodiment the machine controller 112 could comprise a virtual machine control apparatus of the type disclosed in U.S. Pat. No. 4,475,156 to Federico et al.

In one contemplated aspect of the present invention, the respective applied current levels of the corona devices 64–66 and 102 could be controlled by use of a mechanical shutter. For example, referring to FIG. 5B, a spring loaded shutter could be movably mounted to an opening of one or more of the corona devices so that the corona devices could be selectively switched off. Alternatively, for any one of the devices 64–66 and 102, more than one corona emission device could be provided at that location so that the total emission levels at that location could be selectively changed by switching the second device on and off.

Referring again to FIG. 5A, preselected current levels are respectively applied across the corona devices 64–66 and 102 during cycle-up or runtime to enable efficient transfer, detack and cleaning. That is, the respective applied current levels through the corona devices 64–65 are set to obtain optimal transfer, while the respective applied current levels through corona devices 66 and 102 are set to obtain optimal detack and cleaning. When images are developed in the document zones 22 (FIG. 3), little developer material remains on the belt 10 subsequent to transfer so that cleaning of the belt 10 is obtained by adjusting the corona device 102 and the cleaning brush 104 appropriately. When images are developed in both the document zones 22 and the interdocument zones 24, however, a problem in cleaning can arise since the developed patch in each interdocument zone is not typically removed from the belt 10 prior to cleaning. The relatively high quantity of developer material on each developed patch can create a stress condition for the corona device 102. This stress condition can be aggravated if the polarity of each test patch is altered undesirably by the corona devices 64–66. In this case, to achieve desirable cleaning of the developed image in the interdocument zone 24, the settings for the corona device 102 and the cleaning brush 104 may be very different from those settings required to achieve desirable cleaning of the residual toner in the document zone 22. As will become evident from the discussion below, the stress condition to the corona device 102 can be eliminated substantially by selectively switching the applied current levels of one or more of the corona devices so that the developed image in each document zone is conditioned to one charge level while the developed image in each interdocument zone is conditioned to another charge level. While the discussion below is for a highlight color application, the concept underlying the present invention applies with equal force to any printing machine application in which one or more types of developer materials are disposed in document and interdocument zones.

Figure 6:
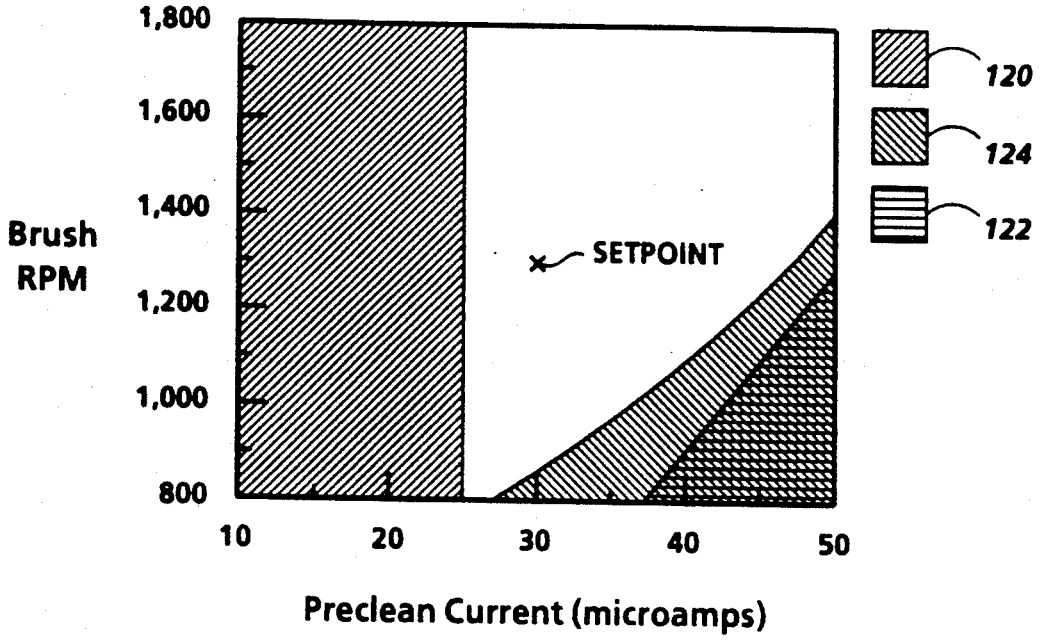
FIG. 6 is a cleaning latitude window showing acceptable set points for the printing machine of FIG. 2, the cleaning latitude window being developed without regard to optimal transfer or detack applied current levels.

For the example, as discussed in FIGS. 6–8, the corona devices 64–66 and 102 possess negative, positive, negative and positive polarities, respectively. Additionally, a non-black developer material, such as a blue or red developer material, and black developer material are recorded and developed on the belt 10, as described above. It will be appreciated by those skilled in the art that the concept of the present invention would apply with equal force to those arrangements in which multiple color developer materials are developed in the document zone 22 and/or the interdocument zone 24. Both of the non-black and black developer materials are formed in the document and interdocument zones. It should be appreciated that each test patch can comprise one or both of the non-black and black toners.

Referring specifically to FIG. 6, a cleaning performance latitude window for the non-black and black developer materials of the document and interdocument zones is shown. Hatched areas 120, 122 and 124, respectively, represent the region in which the non-black residual from the document zone cleans poorly, the region in which non-black residual from the interdocument zone cleans poorly and the region in which black residual from the interdocument zone cleans poorly. No area representing the region in which the black residual from the document zone cleans poorly is shown since the black residual from the document zone can be cleaned sufficiently over a wide range of preclean current settings. While the plot of FIG. 6 illustrates that acceptable cleaning levels can be obtained when preclean current is between 30–35$\mu$ amps and brush speed is between 1000–1800 RPM, it has been found that brush life is optimized and the developer materials are suitably conditioned for removal when a cleaning setpoint of 30$\mu$ amps and 1300 RPM is chosen.

In the present example, optimal transfer and detack of the nonblack and black developer materials from each document zone appears to be obtained when the applied currents of the corona devices 64–66 are set at the following levels:

Pre-Transfer Voltage = −700 v
Transfer Current = +45$\mu$ amps
Detack Current = −10$\mu$ amps.

Referring to FIG. 7, the effect of such transfer and detack parameters on the cleaning latitude window of FIG. 6 is shown. In particular when the pre-transfer, transfer and detack currents are maintained at the above-indicated levels, the black developer material in each interdocument zone becomes overcharged so that optimal cleaning cannot be achieved at the setpoint of FIG. 6.

Referring to FIG. 8, it has been found, for the present example, that excellent cleaning of the developed patch in the interdocument zone can be achieved when the black developer material of the interdocument zone ("Black IDCP") is conditioned with the corona device 102 to have a post pre-clean charge per unit mass in the range of 4–21$\mu$ coul/g. For the illustrated approach of FIG. 8, optimal cleaning can be achieved by setting the detack current of the corona device 66 at −30$\mu$ amps as each interdocument zone is passed thereby and by setting the detack current at −10$\mu$ amps as each document zone is passed thereby.

In view of the discussion above, it will be understood that various techniques can be employed to determine the position of the document and interdocument zones relative to the corona device 66 and to switch the applied current of the same between two or more levels. In particular, the sensing devices 106 can be used to determine when a copy sheet, and thus when one the document zones, has passed by the corona device 66. Additionally, referring to FIG. 5A, switching can be achieved by use of the machine controller 112. Alternatively, switching could be achieved with a controlled shutter arrangement (FIG. 5B) or by providing multiple corona devices 66 and selectively turning them on and off. Finally, the developer material in the document and interdocument zones can be charged precisely by using a narrow corona device 66 or by providing a relatively wide corona device 66 and pulsing it for relatively short durations.

It should be appreciated that while implementation of the present technique is shown with just the corona device 66, the inventive technique could be implemented with any one of, or combination of, the corona devices 64–66 and 102. Additionally, it should recognized that the concept underlying the inventive technique applies with equal force to any printing machine employing a developed test patch in an interdocument zone. For example, the inventive technique could be used to facilitate cleaning in both monochrome and process color systems.

Numerous features of the present invention will be appreciated by those skilled in the art. In particular, the inventive technique disclosed herein alleviates overcharging of developer material in each interdocument zone. Consequently, cleaning can be achieved at an optimal setpoint so that stressing of the various components of the cleaning station is alleviated. Moreover, the inventive technique disclosed herein permits the applied current level of each corona generating device to be adjusted dynamically so that accommodation can be made for varying transfer and cleaning needs of the printing machine.

What is claimed is:

1. A printing machine of the type including an image receiving member having a charge retentive surface with a first developed image being disposed in a first zone and a second developed image being disposed in a second zone, comprising:

a corona generator positioned adjacent the charge retentive surface and characterized by an electrical parameter;

means for setting the electrical parameter to a first level for disposing the first developed image at a first charge level as the first developed image is passed by said corona generator; and means for changing the electrical parameter to a second level for disposing the second developed image at a second charge level as the second developed image is passed by said corona generator; and a cleaning member, contacting the charge retentive surface, for substantially removing both the first developed image and a portion of the second developed image from the charge retentive surface, wherein the capacity of said cleaning member to remove the first developed image and the portion of the second developed image from the charge retentive surface depends on the magnitudes of the first and second levels.

2. The printing apparatus of claim 1, further comprising means, disposed adjacent the charge retentive surface, for transferring a second portion of the second developed image to a substrate positioned adjacent the charge retentive surface.

3. The apparatus of claim 2, wherein said transferring means comprises said corona generator.

4. The printing apparatus of claim 2, further comprising means, disposed adjacent the charge retentive surface and downstream of said transferring means, for assisting stripping of a portion of the substrate away from the image receiving member having a charge retentive surface.

5. The printing apparatus of claim 4, wherein said assisting means comprises said corona generator.

6. The printing apparatus of claim 1 further comprising a pre-clean corona generator disposed upstream of said cleaning member, said pre-clean corona generator being adapted to change the first and second charge levels as the first and second developed images are passed thereby.

7. The printing apparatus of claim 1 in which said corona generator has an opening through which charge is capable of being emitted, wherein said switching means comprises a movable shutter member being disposable between a first position and a second position for selectively controlling the emission of charge through the opening.

8. The printing apparatus of claim 1, wherein a said setting means and said changing means are packaged in a controller, said controller being in communication with said corona generator.

9. The printing apparatus of claim 8 wherein the electrical parameter varies as a function of a signal transmitted from said controller to said corona generator.

10. The printing apparatus of claim 1, further comprising means, disposed adjacent the charge retentive surface, for conditioning the second developed image to transfer a second portion of the second developed image to a substrate positioned adjacent the charge retentive surface.

11. The printing apparatus of claim 10, wherein said conditioning means comprises said corona generator.

12. The printing apparatus of claim 1, wherein at least one of the first developed image and the second developed image comprises first and second toners.

13. The printing apparatus of claim 12 in which said first and second toners possess first and second polarities, respectively, wherein the polarity of said first toner is opposite to the polarity of said second toner.

14. The printing apparatus of claim 1, wherein the first developed image is developed by charged-area development and the second developed image is developed by discharged-area development.

* * * * *